US009297223B2

(12) United States Patent
Richardson

(10) Patent No.: US 9,297,223 B2
(45) **Date of Patent: *Mar. 29, 2016**

(54) TOP DRIVE WITH SLEWING POWER TRANSMISSION

(71) Applicant: WARRIOR RIG LTD., Calgary (CA)

(72) Inventor: Allan Stewart Richardson, The Woodlands, TX (US)

(73) Assignee: Warrior Rig Ltd., Calgary (CA)

( * ) Notice: Subject to any disclaimer, the term of this patent is extended or adjusted under 35 U.S.C. 154(b) by 279 days.

This patent is subject to a terminal disclaimer.

(21) Appl. No.: 13/669,419

(22) Filed: Nov. 5, 2012

(65) Prior Publication Data

US 2013/0055858 A1 Mar. 7, 2013

Related U.S. Application Data

(63) Continuation-in-part of application No. 13/367,305, filed on Feb. 6, 2012, now Pat. No. 8,863,621, which is a continuation-in-part of application No. 12/379,090, filed on Feb. 12, 2009, now Pat. No. 8,109,179.

(60) Provisional application No. 61/064,032, filed on Feb. 12, 2008, provisional application No. 61/071,170, filed on Apr. 16, 2008, provisional application No. 61/555,950, filed on Nov. 4, 2011.

(51) Int. Cl.

| | |
|---|---|
| ***F16H 7/00*** | (2006.01) |
| ***F16H 7/08*** | (2006.01) |
| ***E21B 19/00*** | (2006.01) |
| ***E21B 19/16*** | (2006.01) |

(52) U.S. Cl.

CPC ..... *E21B 19/164* (2013.01)

(58) Field of Classification Search

CPC ..... E21B 19/16; E21B 19/161; E21B 19/164; E21B 19/168; E21B 19/18; B25B 13/5016; F16H 7/02; F16H 7/08; F16H 7/12; F16H 7/22; H02K 7/00; H02K 7/1807; H02K 51/00

USPC ..... 81/57.11, 57.16, 57.22, 57.24, 57.34, 81/57.35; 474/148, 139, 101, 87

See application file for complete search history.

(56) References Cited

U.S. PATENT DOCUMENTS

| | | | | |
|---|---|---|---|---|
| 1,831,353 | A * | 11/1931 | Huxford et al. | 474/87 |
| 4,194,419 | A | 3/1980 | Mitchhart et al. | |
| 4,274,778 | A | 6/1981 | Putnam et al. | |
| 4,765,401 | A | 8/1988 | Boyadjieff | |
| 4,979,356 | A | 12/1990 | Vatne | |

(Continued)

FOREIGN PATENT DOCUMENTS

| | | |
|---|---|---|
| CA | 2390365 | 9/2002 |

*Primary Examiner* — Hadi Shakeri

(74) *Attorney, Agent, or Firm* — Oyen Wiggs Green & Mutala LLP

(57) ABSTRACT

A power transmission for a slewing interface includes a rotor rotatable relative to a stator about a slewing axis, at least one drive sprocket mounted on the stator adjacent the rotor, a first drive cooperating with the at least one drive sprocket, at least two satellite sprockets on the rotor and spaced around the rotor, at least one drive belt mounted around the drive sprockets and around the satellite sprockets in driving engagement collectively therewith, power is delivered continuously from the first drive to at least one of the satellite sprockets at all times during rotation of the rotor about the slewing axis.

27 Claims, 24 Drawing Sheets

(56) References Cited

U.S. PATENT DOCUMENTS

| | | | | |
|---|---|---|---|---|
| 5,167,173 | A | 12/1992 | Pietras | |
| 5,271,298 | A * | 12/1993 | Gazel-Anthoine | 81/57.16 |
| 6,082,225 | A | 7/2000 | Richardson | |
| 6,705,405 | B1 * | 3/2004 | Pietras | 81/57.33 |
| 6,752,044 | B2 | 6/2004 | Hawkins, III | |
| 6,776,070 | B1 | 8/2004 | Mason et al. | |
| 7,000,502 | B2 | 2/2006 | Belik | |
| 7,313,986 | B2 | 1/2008 | West et al. | |
| 7,437,974 | B2 | 10/2008 | Slettedal et al. | |
| 2008/0282847 | A1 | 11/2008 | Halse | |
| 2009/0211404 | A1 | 8/2009 | Pedersen et al. | |
| 2009/0314137 | A1 | 12/2009 | Perez | |
| 2011/0030512 | A1 * | 2/2011 | Begnaud, Jr. | 81/57.34 |

* cited by examiner

TOP DRIVE WITH SLEWING POWER TRANSMISSION

CROSS REFERENCE TO RELATED APPLICATION

This is a Continuation-in-Part of U.S. patent application Ser. No. 13/367,305 entitled Power Tong filed Feb. 6, 2012, incorporated herein by reference, which is a Continuation-in-Part of U.S. patent application Ser. No. 12/379,090 entitled Power Tong filed Feb. 12, 2009, now U.S. Pat. No. 8,109,179, which claimed priority from U.S. Provisional Application No. 61/071,170 entitled Power Tong filed Apr. 16, 2008 and U.S. Provisional Application No. 61/064,032 filed Feb. 12, 2008. The present application claims priority from U.S. Provisional Application No. 61/555,950 entitled Top Drive With Slewing Power Transmission filed Nov. 4, 2011.

FIELD OF THE INVENTION

This invention relates to the field of power transmissions for use with for example, top drives and in particular to a slewing power transmission, for conveying energy for example between a top drive and a slewing pipe handler.

BACKGROUND OF THE INVENTION

In the prior art of which the applicant is aware, conventional top drives employ a slewable pipe handler assembly. Prior art pipe handlers normally include a number of remote controlled mechanised functions, for example, link tilt, make-up and break-out and/or backup wrench gripping, wrench axial positioning, well control valve actuation, elevator open/close actuation and elevator axial cushioning. Power or energy, and control of the pipe handler is typically transmitted to the pipe handler across the slewing interface between the top drive and the pipe handler, where conventionally the slewing interface is hydraulic or pneumatic and such transmissions are via a multi-channel fluid rotary union, as would be known to one skilled in the art.

In applicant's experience, the conventional fluid rotary unions at the slewing interface are prone to failure and in particular prone to failure at the rotary union seals. Failure can be between channels, resulting in loss of functionality, or external resulting in leakage as well as functionality loss. Inter-channel failures usually result in loss of functionality of two functions. A conventional slewing interface will have many seals, and in applicant's experience, normal wear and tear during conventional drilling operations causes one or more seals to fail. Leakage of hydraulic fluid from a hydraulic rotary union will cause hydraulic fluid to drip down onto the rig floor and personnel. Additionally, such rotary union seals typically have poor accessibility for servicing and require specialized technicians to do such servicing.

In the case of conventional fluid rotary unions, although undesirable and impractical, fluid-based sensors may be provided on the pipe handler, although usually the use of conventional fluid rotary unions means that no sensors are employed at all. The use of electronic sensors is desirable, however, to applicant's knowledge in the prior art attempts to employ wireless data communication across a fluid rotary union have required the use of battery power from batteries on the pipe handler system. The obvious drawback of having to use batteries is the batteries' limited battery life before swapping out or recharging of the batteries is required.

SUMMARY OF THE INVENTION

In summary, the power transmission for a slewing interface according to one aspect of the present invention may be characterized as including:

(a) a rotor rotatable relative to a stator about a slewing axis, at least one drive sprocket mounted on the stator adjacent the rotor, (b) a first drive cooperating with the at least one drive sprocket, (c) at least two satellite sprockets on the rotor spaced around the rotor, (d) at least one drive belt mounted around the at least one drive sprocket and around the at least two satellite sprockets in driving engagement collectively therewith.

Power is thereby delivered continuously from the first drive to at least one of the at least two satellite sprockets at all times during rotation of the rotor about the slewing axis.

The transmission may further include a slewing drive acting between the rotor and the stator, whereby the rotor is selectively slewed relative to the stator about the slewing axis. The rotor may be adapted for mounting an object thereto for rotation with the rotor, and in one form of the invention the object is mounted to the rotor. By way of example, the object may be a pipe handler. In one embodiment, the stator may be mounted to a top drive.

Advantageously the satellite sprockets are mounted substantially equally radially spaced from the slewing axis, and so that a satellite sprocket spacing between adjacent satellite sprockets is substantially equal. In one embodiment the satellite sprocket spacing and the equal radial spacing of the satellite sprockets, the diameter of each of the satellite sprockets, and a spacing of the at least one drive sprocket from the slewing axis and the satellite sprockets is such that the drive belt will not contact the object, when the object is mounted to the rotor, during rotation of the rotor about the slewing axis.

In one embodiment a synchronizer synchronizes rotation of all of the satellite sprockets.

In a further embodiment at least one load is mounted on the rotor and coupled to the at least one satellite sprocket. The load may include an energy conveyor chosen singly or in combination from the following group, which is not intended to be limiting: an energy transfer medium, at least one hydraulic fluid pump, at least one pneumatic pump, at least one fluid pump which is other than hydraulic or pneumatic, at least one generator, at least one alternator, a mechanical drive, a mechanical linkage, an electric drive. The at least one load may also power at least one pipe handler function chosen from the group including: a gripper, a gripper positioner, a link tilt, a valve actuator, an elevator operator. Advantageously the at least one load may power an electrical control system. The at least one load may power a wireless communicator. Further, the load may include energy storage, for example chosen from the group which includes at least one gas accumulator, at least one battery, at least one capacitor, at least one flywheel.

In a preferred embodiment a tensioner cooperates with the drive belt to maintain tension in the drive belt as the rotor rotates. The drive belt may be at least one flexible loop member including a belt, chain, or cable. In embodiments employing a synchronizer, the synchronizer may be at least one flexible loop member, including a belt, chain, or cable, which is mounted around all of the satellite sprockets.

Advantageously the first drive runs continuously to continuously supply power to the at least one load, independently of the rotation of the rotor.

In further embodiments the satellite sprockets may include a minimum number of three satellite sprockets, or may include a minimum number of four satellite sprockets.

In yet a further embodiment at least two drive sprockets are provided, having a corresponding at least two drive belts, one drive belt for each drive sprocket. Each drive belt disengages from at least one satellite sprocket across a corresponding drive gap as the rotor rotates. Advantageously the at least two drive sprockets are spaced apart by a drive sprocket angular spacing which is greater than the angular magnitude of any of the drive gaps.

The rotor may be substantially a plate. The stator may also be substantially a plate. The first drive may be mounted to the stator.

A system according to a further aspect of the present invention includes the transmission first described above and a top drive mounted on top of, and to, the stator, and may further include a pipe handler mounted under, and to, the rotor. The stator may include a first central opening. The rotor may include a second central opening aligned along the slewing axis with the first central opening for receiving a quill extending from the top drive and through the first and second central openings.

BRIEF DESCRIPTION OF THE DRAWINGS

FIG. 18*a*' is the view of FIG. 18*a* showing the drive sprocket angular spacing and a drive gap angle.

DETAILED DESCRIPTION OF EMBODIMENTS OF THE INVENTION

Figure 1:
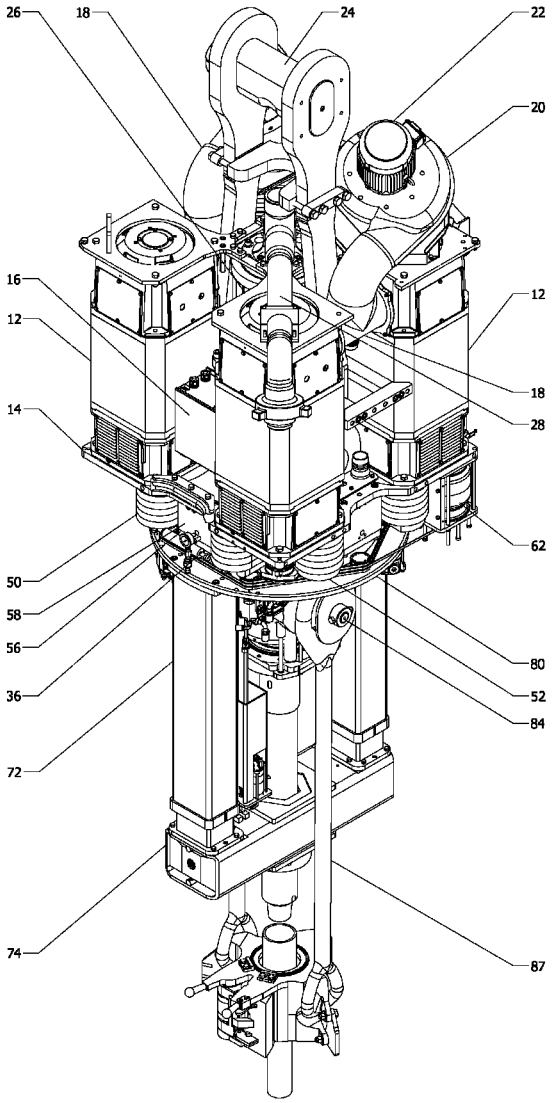
FIG. 1 is, in perspective view, a top drive according to one embodiment of the present invention.
Figure 2:
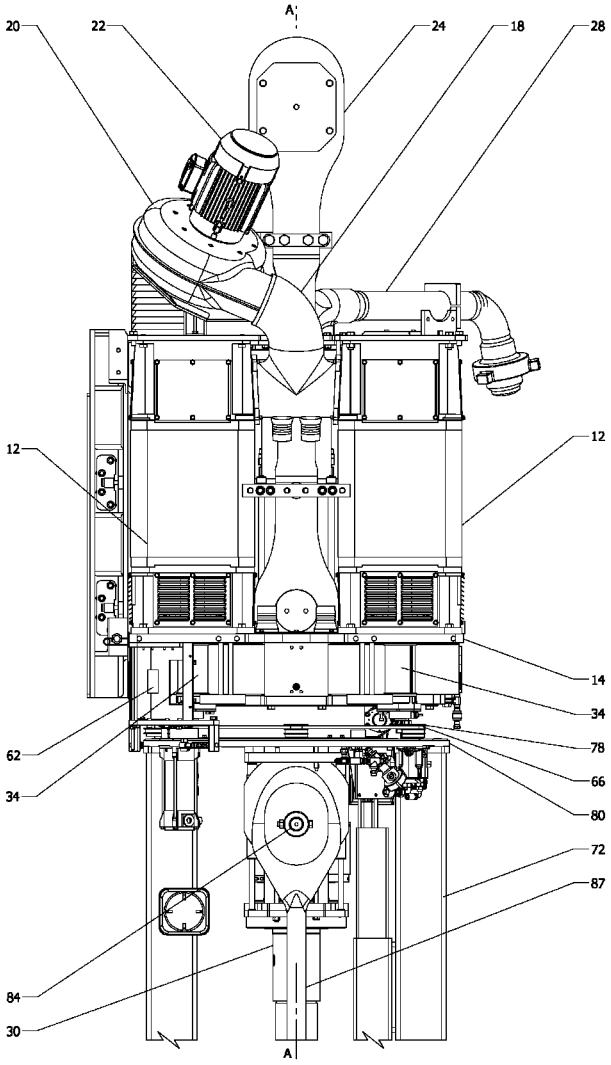
FIG. 2 is a section view along line 2 in FIG. 1.
Figure 3:
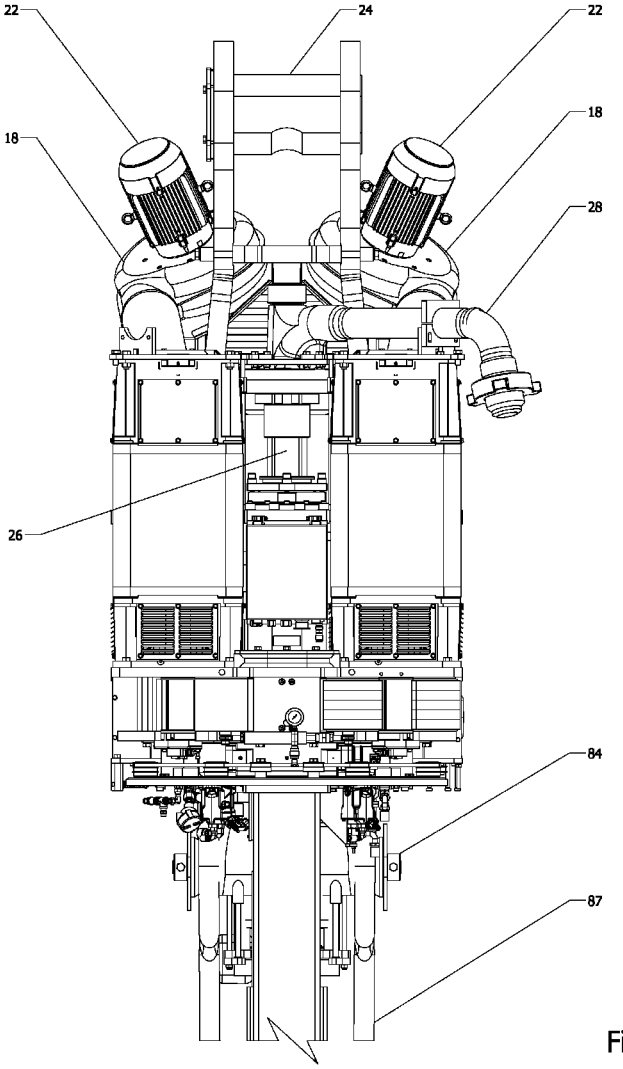
FIG. 3 is a section view along line 3 in FIG. 1.
Figure 4:
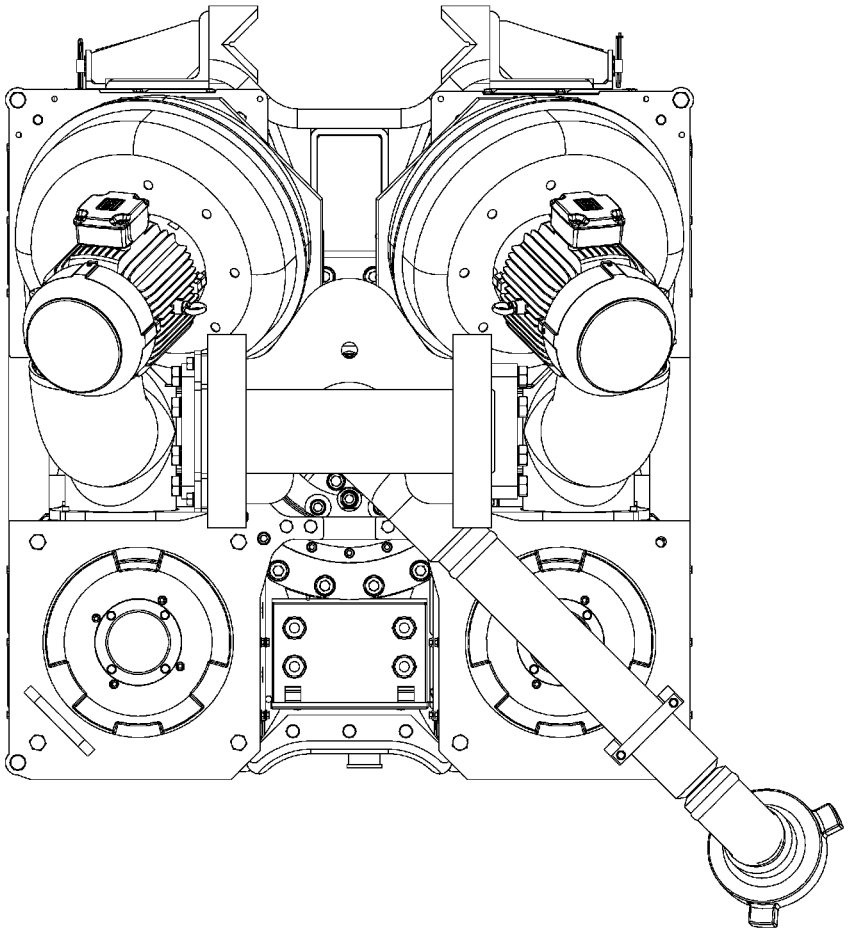
FIG. 4 is a plan view of the top drive of FIG. 1.
Figure 5:
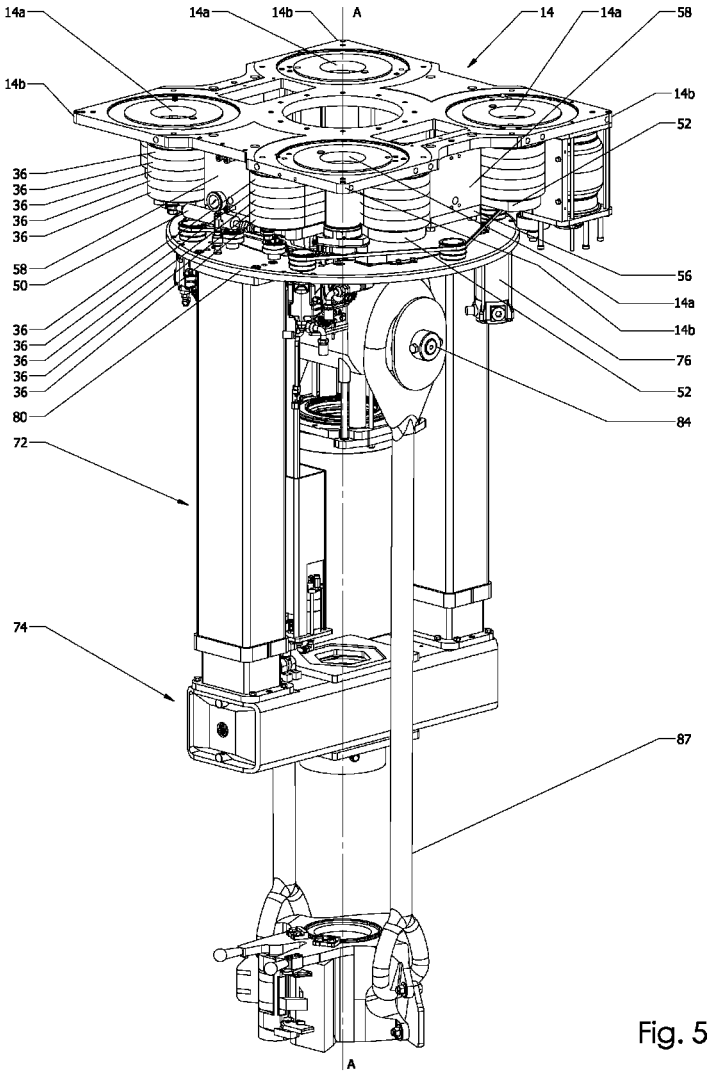
FIG. 5 is the perspective view of FIG. 1, partially cut away, to expose the drive plate.
Figure 6:
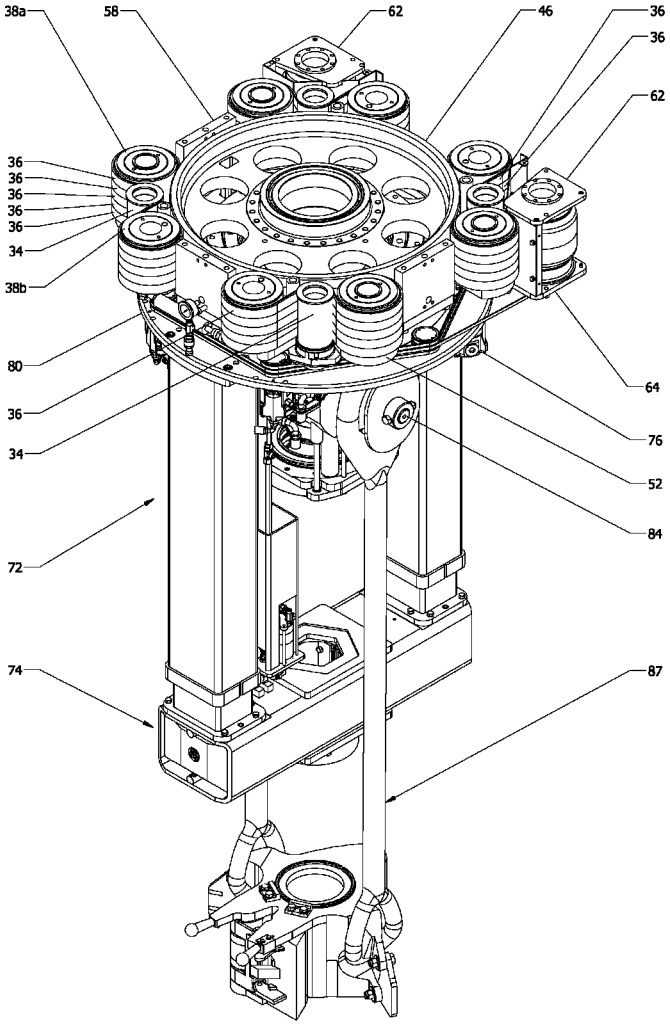
FIG. 6 is the view of FIG. 5 with the drive plate removed to show the power transmission employing independent belted transmissions.
Figure 7:
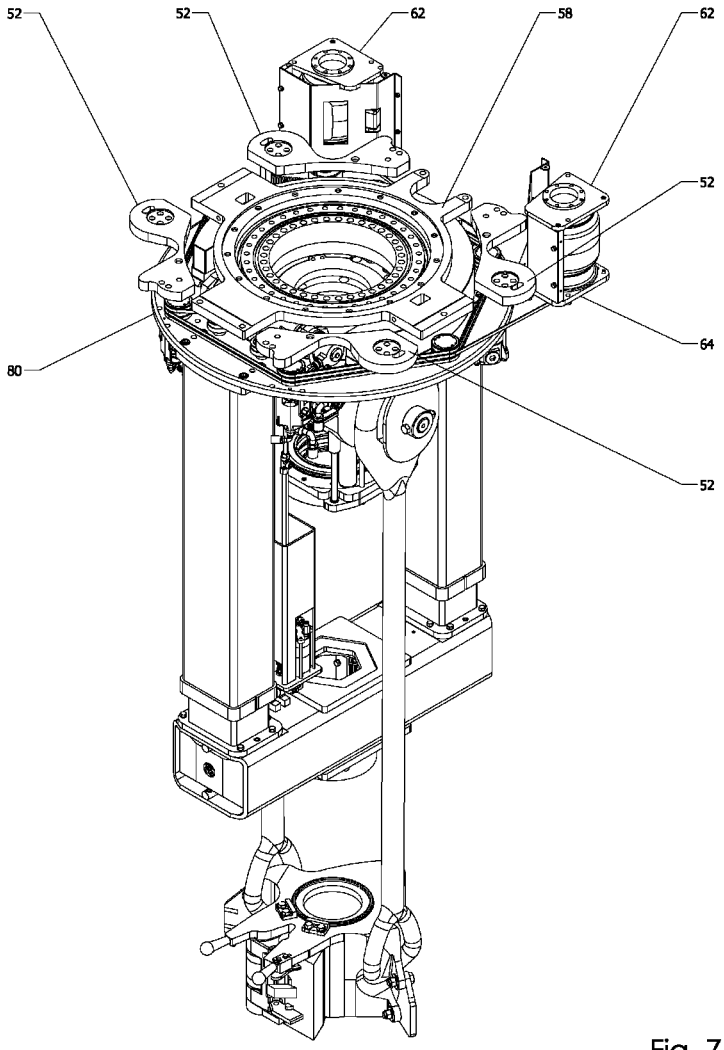
FIG. 7 is the view of FIG. 6 with the power transmission cut away to expose the bottom plates covering the slewing swivel.
Figure 8:
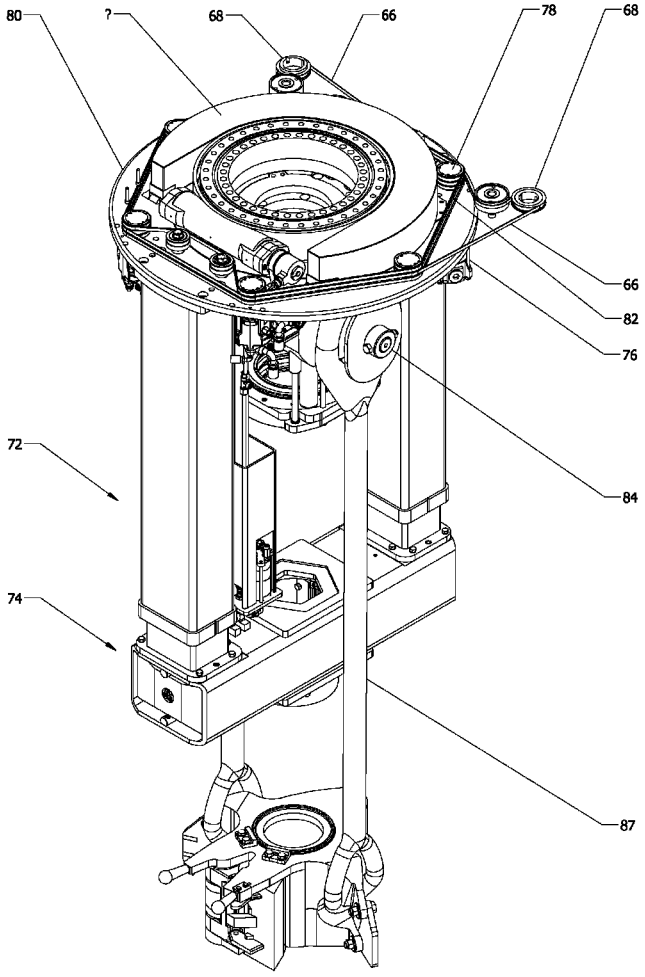
FIG. 8 is the view of FIG. 7 with the bottom plates cut away to expose the slewing swivel, the wrench support and the rotating power transmission for the slew actuators.

As seen in the accompanying Figures wherein like reference numerals denote corresponding parts in each view, the assembled top drive shown in FIG. 1 includes four modularly mounted variable frequency drive AC motors 12 mounted on a drive plate 14. Other types of motors, such as hydraulic, may be used. As better seen in FIG. 5, in one preferred embodiment, in order to provide balancing of the top drive about its centre or drive axis A, mounts for receiving motors 12 (not shown in FIG. 5) are provided in each of the four corners of plate 14. Advantageously, the motor housings surrounding each motor 12 mount snugly and conformally around the corresponding receiving bores of plate 14 so as to align the motor drive shafts 12*a* with a corresponding aperture 14*a* in plate 14. Thus the arrangement of motors 12 on plate 14 around axis A may be described as a plurality of electric motors spaced apart radially and equally about drive axis A. As may be seen &om the bolt hole pattern on plate 14, motors 12 may be simply bolted down onto plate 14 which, because of their placement on plate 14 so that they are exposed outwardly of the plate, provides for ease of removal and installation in the event that for example one of motors 12 fails.

Motors 12 and plate 14 are sized relative to each other to provide open spaces between the motors into which are mounted electrical junction boxes 16. Also, the spaces or gaps between motors 12, which may in one embodiment be in the order of 12 inch wide gaps, provide for air ducting 18 which directs air from blowers 20, themselves driven by electric motors 22, so as to provide cooling air for motors 12. In a preferred embodiment, two blowers 20 are provided, each providing cooling air flow into the motor housings into a corresponding pair of motors 12 via corresponding ducting 18. A hoisting collar 24 is provided, which straddles the central drilling mud conduit 26. Drilling mud is provided to conduit 26 via drilling mud supply pipes 28. Drilling mud is pumped through pipes 28 and down through central conduit 26 so as to exit downwardly from the internal bore of quill 30 along drive axis A.

Figure 9:
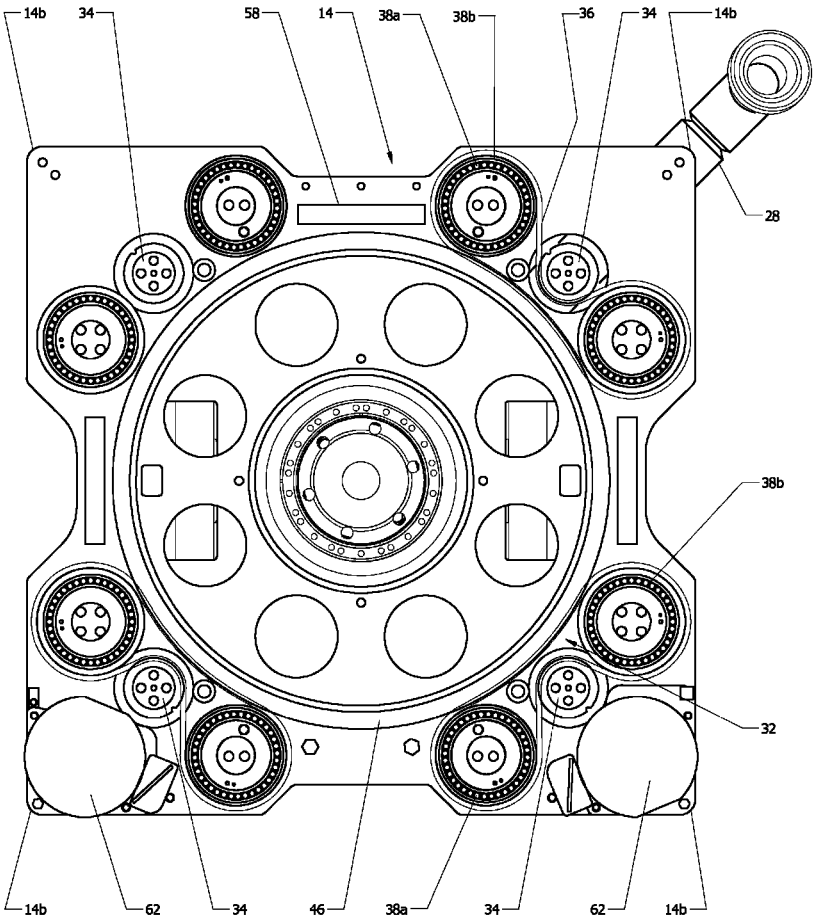
FIG. 9 is a bottom view looking up along line 9 in FIG. 1.
Figure 9A:
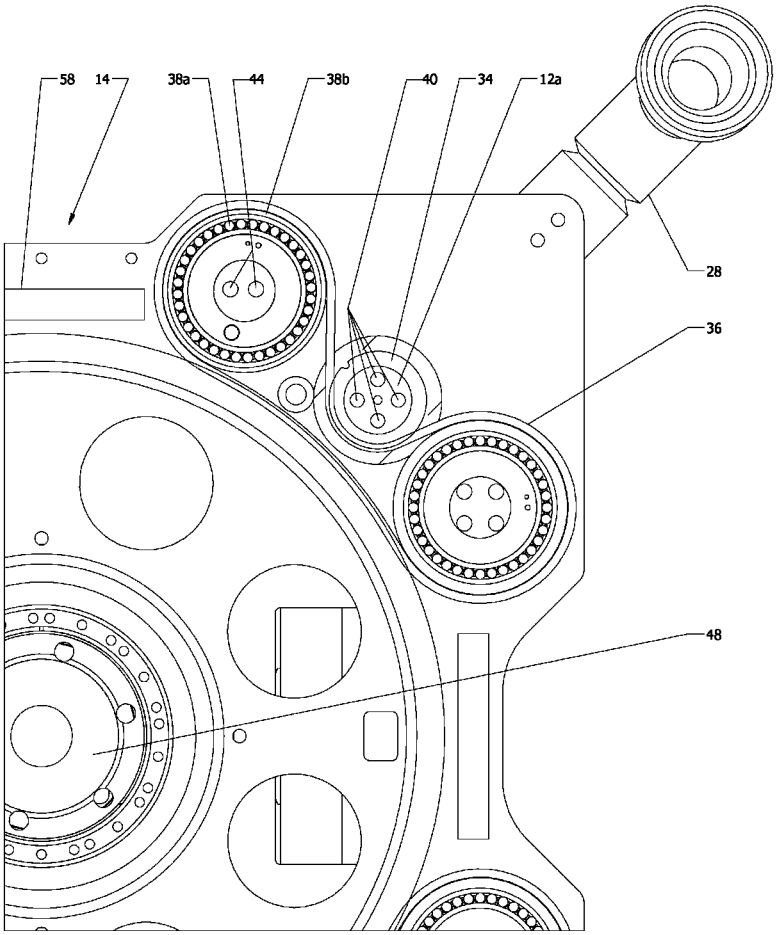
FIG. 9*a* is a partially cut away bottom view looking up at one belted transmission with the bottom plates removed to expose the engagement of the belts with the motor sprocket and bolt sprocket.
Figure 10:
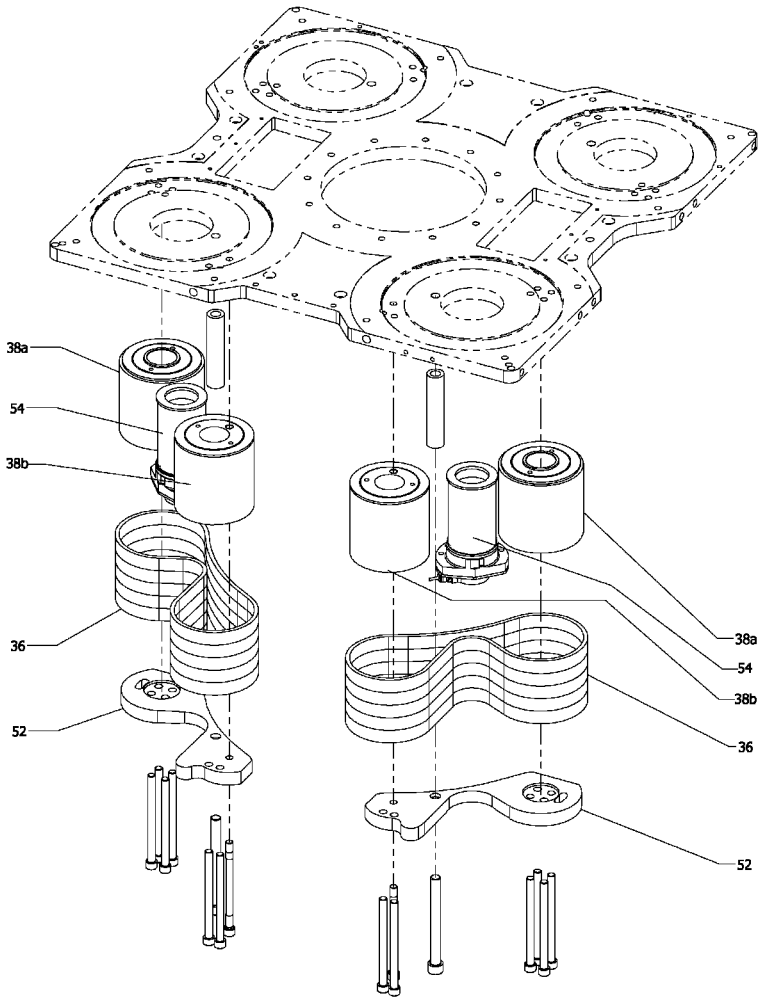
FIG. 10 is a partially cut away exploded view of the belts, idlers and associated bottom plates of two belted transmissions which mount up under the drive plate shown in dotted outline.
Figure 10A:
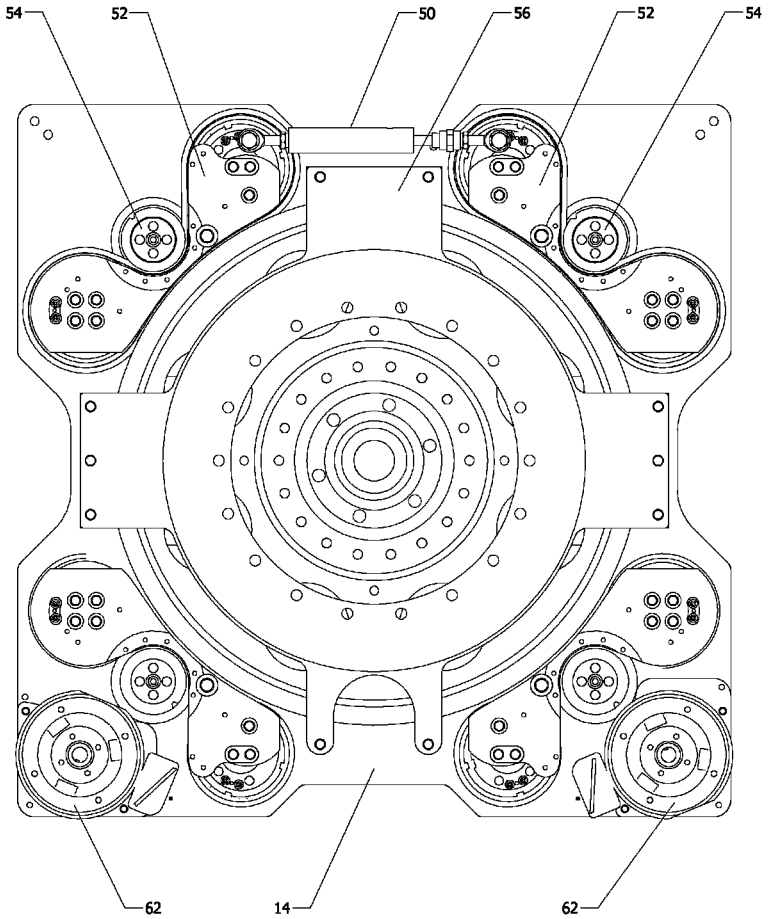
FIG. 10*a* is the bottom view of FIG. 9 with the bottom plates and motor sprocket end caps installed.

Motors 12 drive their corresponding motor drive shafts 12*a*. Each motor shaft 12*a* drives its own corresponding belted transmission as better seen in FIGS. 9 and 10. The belted transmission as shown in FIG. 9 is generally indicated at 32 and includes a motor sprocket 34 driving a stack of toothed belts 36. Each belt 36 rounds idlers 38*a* and 38*b* mounted oppositely disposed on either side of sprocket 34. Idler 38*a* is mounted upwardly fixedly to the underside of drive plate 14 for example by means of bolts using bolt hole pattern 40. Idler 38*b* may be mounted by means of an eccentric to the underside of drive plate 14 for example by the use of idler eccentric pivot 42, whereby upon pivoting idler 38*b* about pivot 42 so as to tension belt 36, the position of idler 38*b* may be fixed to the underside of drive plate 14 by means of bolt holes 44. As will be appreciated, other means for tensioning bolt 36 will also work, for example by the use of a linear slide as would be known to one skilled in the art. As will further be appreciated, the teeth (not shown) on the outside of belt 36 continue around the entire length of belt 36 so that the teeth engage against the corresponding teeth (not shown) on bull sprocket 46. Bull sprocket 46 is rigidly mounted to the top drive main shaft 48 whereby rotational power is delivered to quill 30 by the contribution of each of the four motors 12 and their corresponding independent belted transmissions 32.

In one embodiment, although this is not intended to be limiting, the stack of tooth belts 36 includes a closely adjacent vertically stacked stack of five such belts 36. The reason that number of belts are stacked one on top of the other is merely that such belts are conventionally supplied with the teeth to the inside of the belt, and so with the relatively stiff, for example carbon fibres impregnated, belts used to convey the considerable power generated by each motor 12 so as to impart that power to bull sprocket 46, it can be difficult to invert each belt 36 so as to dispose that belt's teeth outwardly. The narrower the belt, the easier it is to invert the belt so as to outwardly expose the teeth. It may be that a single monolithic belt may be employed, for example if manufactured with the teeth outwardly disposed. Thus in the example illustrated, each belt may be described as having 14 mm pitch, with dimensions of 37 mm by 1610 mm.

Identical belted transmissions 32 are mounted under each corner 14*b* of drive plate 14. Extension tool 50 is an example of a tool which is used to pivot idler 38*b* about pivot 42 so as to tension belt 36. Preferably extension tool 50 is hydraulic although a mechanical screw or other suitable extension mechanism would work. Once the tension is set and the eccentric anchored to drive plate 44, tool 50 is removed, and the process repeated at each corner 14*b* for each belted transmission 32 which have had belts changed or during setup or periodically to take up slack due to belt wear or stretching. Belts 36 are held in place on idlers 38*a* and 38*b* by means of bottom plates 52 nested against flanged end cap 54 mounted over motor sprockets 34. A bottom plate 56 is mounted substantially in the plane containing bottom plates 52, and is mounted rigidly to drive-plate 14 by means of rigid spacing columns 58. Cover plates 60 are mounted up under corners 14*b* of plate 14 so as to enclose belts 36.

What follows is a description of a slewing power transmission which is mounted to a top drive. One such top drive is described above. However, and without intending to be limiting, other types of top drives would also work. For example, the top drive may include a gear drive or be a direct drive, that is, having no gear reduction, with motors concentric with the top drive axis (axis A), and wherein the motors may be electric or hydraulic for example, and wherein belts may also be used instead of or in conjunction with gears, or not at all.

By reference to a slewing power transmission, what is intended is to refer to a system which includes a rotary or slewing union, which is not a fluid rotary union, and which supplies energy or power, for example for actuators and for the generation of electricity, to a slewable pipe handling device which slews about axis A (its slewing axis) such as conventionally includes a wrench frame 72 supporting a pipe handling wrench 74, and again however, importantly, without the use of a fluid rotary union as is conventionally employed. Thus it is one object to provide an improved slewing power transmission, for example, for use under a top drive, which provides improved reliability, serviceability, and improved instrumentation feedback capabilities, power for an electric control system on the pipe handler, wherein the electric control system may include wireless communication provisions.

In the present invention the slewing interface is not merely a slewing interface employing a fluid rotary union to transmit motivating power to the pipe handler but is a rotary drive and power coupling in the sense that not only is selectively controlled slewing of the pipe handler provided at the interface between the top drive and the pipe handler, but the use of a fluidless power transmission provides energy or power to the pipe handler, for example for actuators and for the generation of electricity, thereby providing power to pipe handler accessories, such as described below, and providing power for an electric control system. Such an electric control system may include provisions for the wireless transmission of data between the top drive or elsewhere and the pipe handler. Data could be transferred between the pipe handler and the rig or a cell tower or satellite. Mechanical energy is transferred across the slewing interface, which may be used on the pipe handler in various ways, e.g. hydraulic, electric, pneumatic or mechanical to do work and/or for control systems. To realize control and instrumentation benefits, some or all of the transferred mechanical energy is converted into electrical energy. Again, the substitution of a fluidless power transmission for a fluid rotary union reduces maintenance, reduces fluid leaks which increases safety on the rig floor, and enables improved data communication between the top drive and pipe handler. Electrically powered accessories on the pipe handler may include for example a video camera, for still or motion photography, monitoring, streaming of a video feed, for remote recording, monitoring, or diagnostics, or for remote operation. Again, the data from the accessories may be provided to the top drive, or to elsewhere on the drilling rig, or may be provided to remote locations by wireless transmission according to known methods.

Thus what is an improvement over the use of conventional fluid rotary unions at the slewing interface between top drives and pipe handlers, and which it is an object of the present invention to provide, is to firstly increase reliability of the slewing interface by the use of a slewing power transmission which does not include rotary union seals, and thereby to then eliminate for example hydraulic fluid/oil leakage due to external rotary union seals failing, and to also thereby reduce the extent and complexity of the hydraulic fluid system lines, again thereby reducing the associated fluid leakage. It is further desirable, and a further object of the present invention to provide, improved serviceability at the slewing interface by providing a slewing power transmission which is, for the most part, externally serviceable, and which it is intended will require significantly less expertise in order to perform such servicing. Further, the slewing power transmission at the slewing interface according to another aspect of the present invention provides energy or power across the slewing interface for example for the generation of electricity. Thus in the present application, which is not intended to be limiting, energy is provided to the pipe handler so as to, for example, enable an electric control and instrumentation system. The electrical system may include, but is not limited to, solenoids, motors, relays, switches, sensors, programmable controllers, memory unites, wireless communication systems, still cameras, and/or video cameras. This provides power to various loads or accessories such as for example wireless transmitters or the like for transmitting data, information, etc from the pipe handler, wherein the accessories may thus for example include sensors and the data is feedback from the sensors, etc. Thus by the providing of power across the slewing interface electronic sensing instrumentation in, and electronic data transmission from the pipe handler are enabled, advantageously by wireless data communication, because continuous electrical power is now provided by the slewing power transmission to the pipe handling assembly without the limitations of being reliant on batteries, and thereby, through the expanded use of instrumentation and sensors the functionality and safety of the pipe handling system is improved. That is, such an electric and instrumentation system is impractical with a fluid rotary union system because electrical power is limited to battery capabilities which have limited life.

Figure 11:
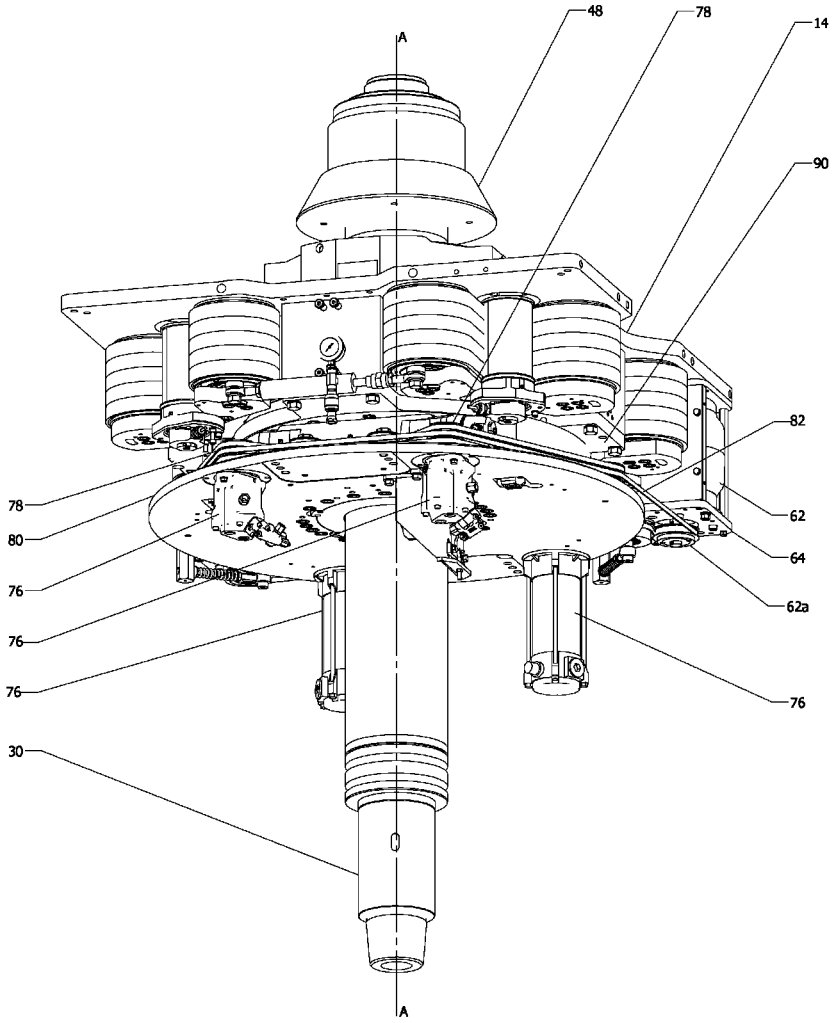
FIG. 11 is, in bottom perspective view, the belted transmissions and slewing power transmission according to one embodiment of the top drive.
Figure 12:
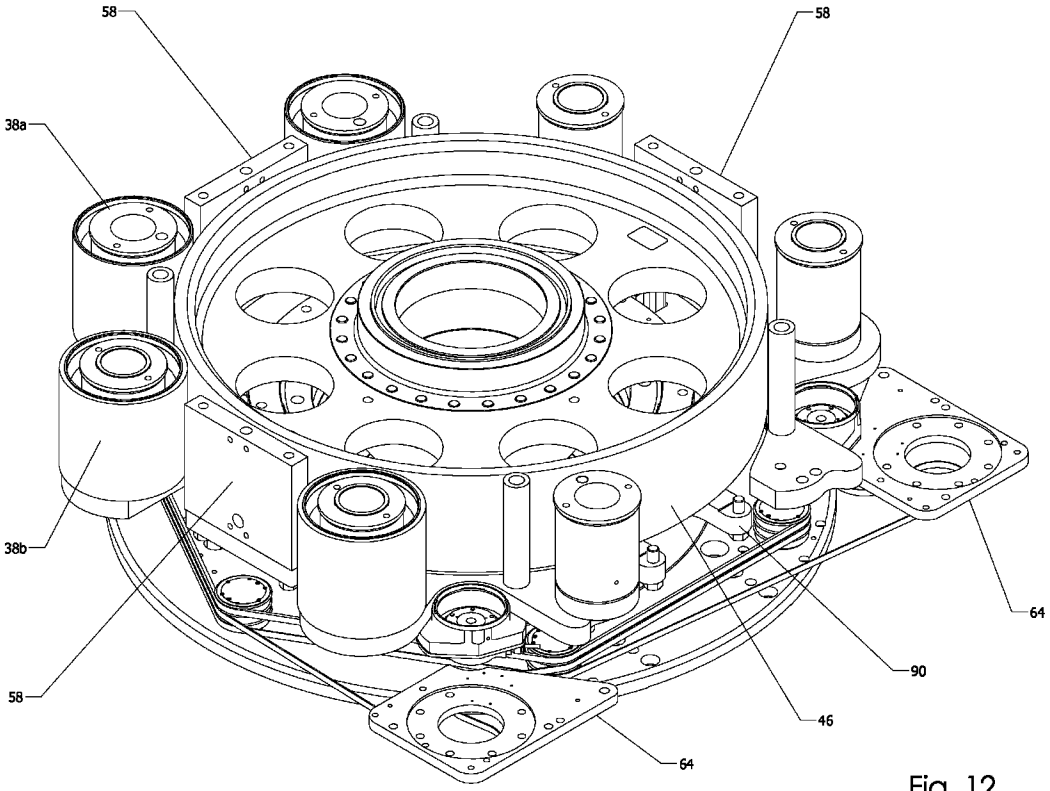
FIG. 12 is, in partially cutaway, top perspective view, the bull sprocket mounted on the stator plate of the belted transmission of FIG. 11 and showing the mounting plate for the electric motors for the slewing power transmission.
Figure 13:
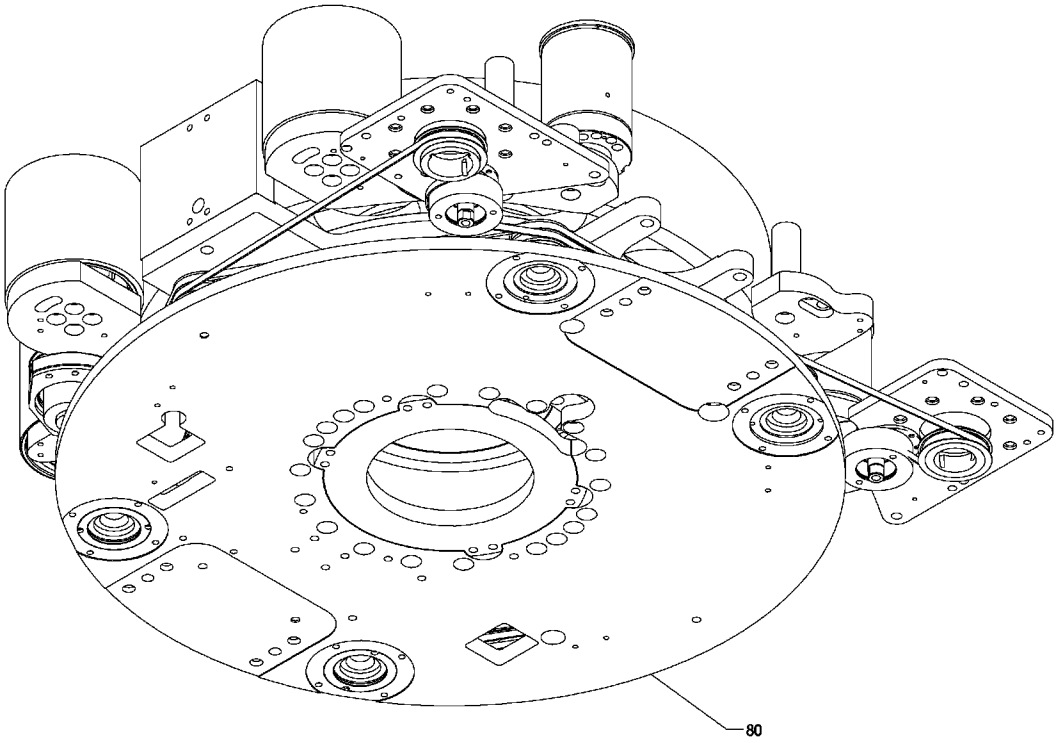
FIG. 13 is, in bottom perspective view, the partially cutaway belted transmission and slewing power transmission of FIG. 12, partially cutaway to expose the underside of the rotor plate.
Figure 14:
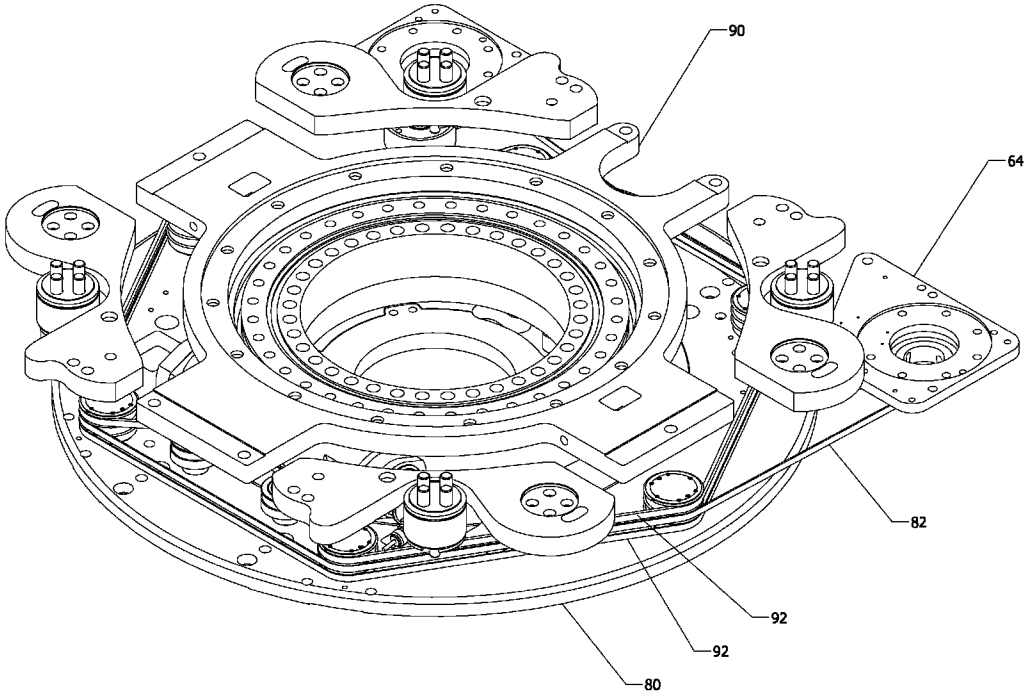
FIG. 14 is, in partially cutaway top perspective view, the belted transmission and slewing power transmission of FIG. 12 cutaway to expose the stator plate.
Figure 15:
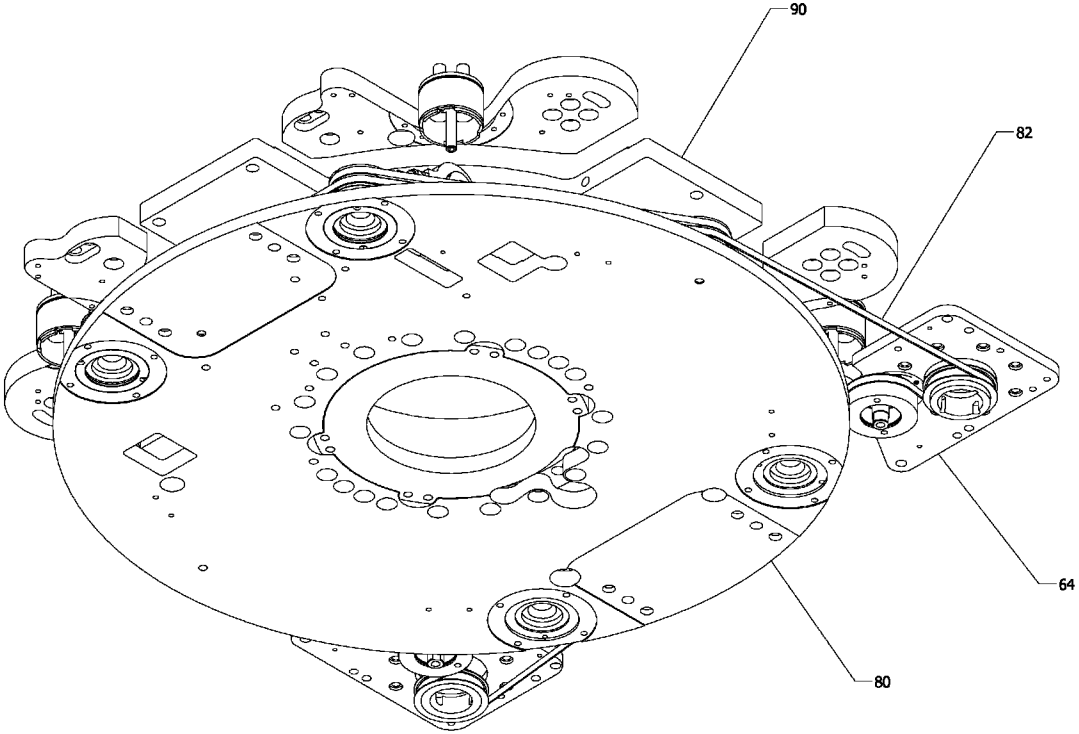
FIG. 15 is, a bottom perspective view of the partially cutaway slewing power transmission of FIG. 14.
Figure 16:
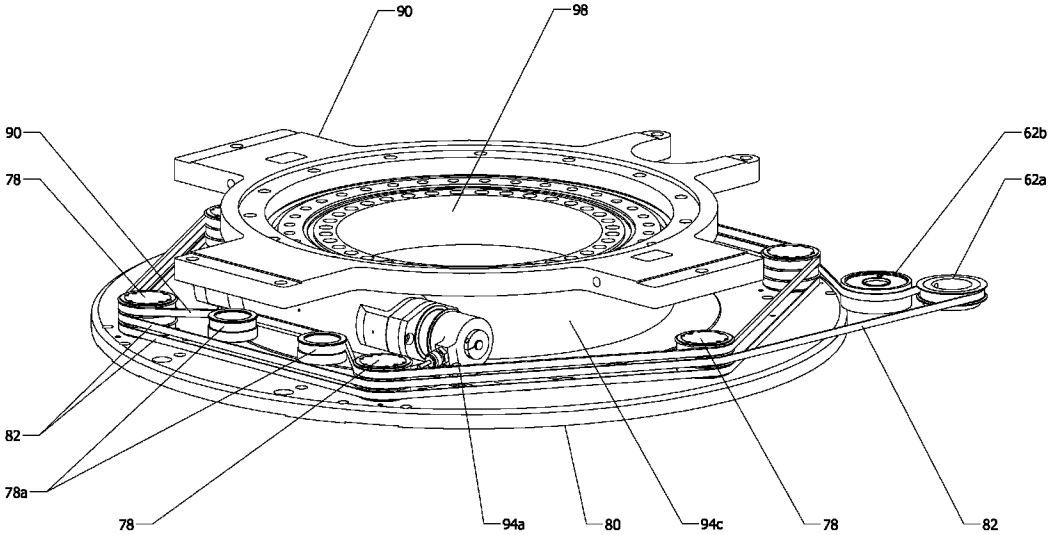
FIG. 16 is, in side perspective view, the stator and rotor plates of FIG. 14 showing the synchronization and drive belts mounted around the satellite sprockets on the rotor plate and showing one drive belt mounted around a drive sprocket, the corresponding electric motor and mounting plate cutaway.
Figure 17:
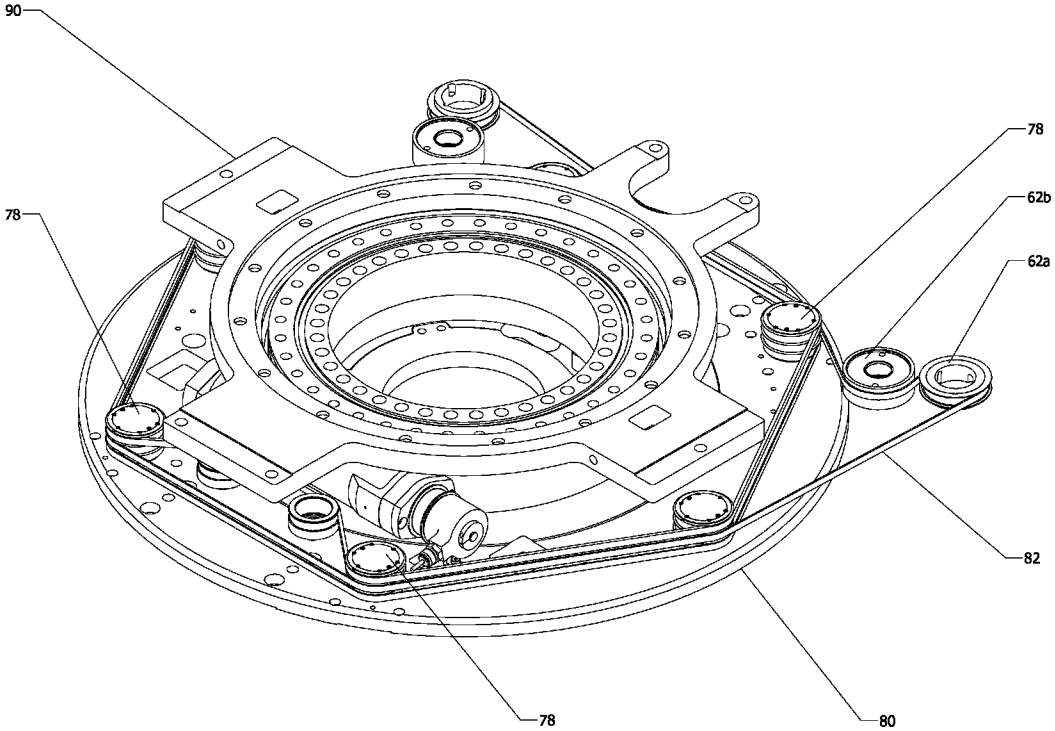
FIG. 17 is, in top perspective view, the stator and rotor plates, satellite and drive sprockets, and synchronization and drive belts of FIG. 16.

Thus as seen in the accompanying drawings commencing in FIG. 11 wherein, again, like reference numerals denote corresponding parts in each view, and as the term "slewing union" used herein implies, the pipe handler system is required to selectively rotate or slew about center or drive axis A relative to the frame of reference of the top drive mounted above the slewing union.

The frame of reference may for other applications of the slewing power transmission which is the subject of the present invention, be merely the frame-of-reference of a body, such as a frame or foundation or other supporting structure, which does not move or is fixed relative to the slewing motion of the rotor, and as used herein such frame of reference is included within the definition of a stator.

Thus in the present example, which is not intended to be limiting, where the slewing power transmission is employed between the top drive and pipe handler, as stated above, bull sprocket 46 is driven by drive belts 36. Drive belts 36 are mounted on idlers 38*a* and 38*b* and driven by motor sprockets 34 mounted to motors 12. The idlers 38*a* and 38*b*, and spacing columns 58 are mounted onto stator plate 90. Thus by operation of motors 12, bull sprocket 46 may be rotated to thereby rotate main shaft 48 and quill 30 so as to rotate the drill string when attached thereto.

Independently of the rotation of the main shaft, quill and drill string, the pipe handler assembly mounted under the pipe handler rotor 80 slews around center axis A so as to slew the pipe handling assembly including wrench or gripper 74, on wrench frame or gripper leg 72 and the associated link tilt cylinders (not shown) and links 87 on supports 84, by the operation of a slewing position actuator. The slewing position actuator may be for example a worm drive 94 driving gear ring 96 about internal race 98, wherein gear ring 96 is mounted up underneath and to stator plate 90. In the illustrated embodiment wherein worm drive 94 is hydraulically actuated, worm drive 94 is driven by hydraulic motors 94*a* and housed within a housing 94*b*. Hydraulic fluid for motors 94*a* is maintained within a reservoir 94*c* which is mounted on rotor 80 so as to surround gear ring 96. Thus the selective operation of the slewing position actuator selectively slews the pipe handling assembly. As will be appreciated by one skilled in the art, the slewing position actuator may be other than a hydraulically actuated worm drive, and may be located on the stator or fixed structure instead of on the rotor or slewing structure.

Whether the rotor 80 is actively being slewed or not by the slewing position actuator, loads 76, such as for example pumps for fluid systems, generators for electrical systems including an electrical control system, compressors for pneumatic systems on the pipe handler, mounted under and to rotor 80, each corresponding to driven satellite sprockets 78, are continuously powered by the operation of one or more drive belts 82 driven by motors 62 mounted on mounting plate 64.

Figure 20A:
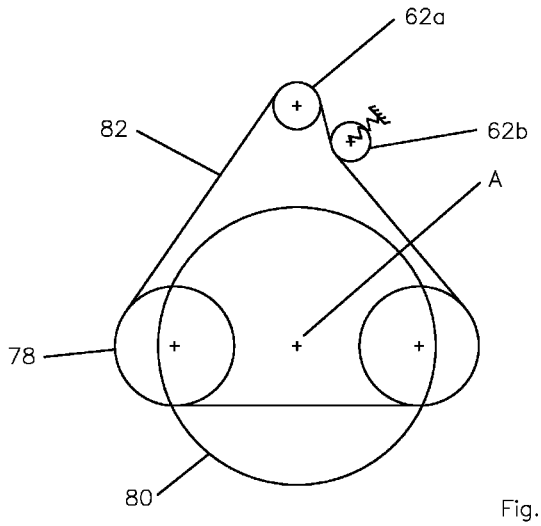
FIG. 20*a* is, in diagrammatic plan view, an alternative embodiment of the slewing power transmission employing a pair of satellite sprockets on the rotor, shown equidistant from the drive sprocket.
Figure 20B:
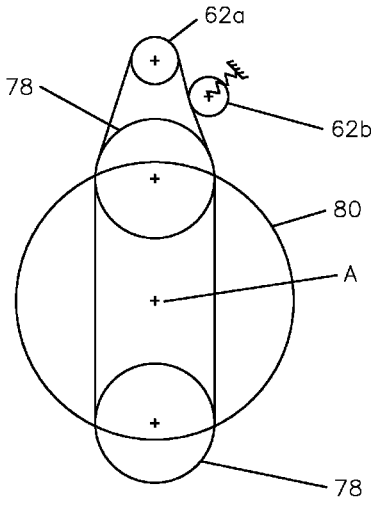
FIG. 20*b* is the slewing power transmission of FIG. 20*a* with the rotor rotated so that the satellite sprockets are inline with the drive sprocket.

The electrical system may include, but is not limited to, solenoids, motors, relays, switches, sensors, programmable controllers, memory units, wireless communication systems, still cameras, and/or video cameras. Although six satellite sprockets 78 are illustrated in FIGS. 11-19, as seen in FIGS. 20*a* and 20*b* two or more satellite sprockets 78 will also work, as for example employed in the embodiment of FIGS. 20*a* and 20*b*. Motors 62 maybe for example electric or hydraulic, but this is not intended to be limiting. Although two motors 62 are illustrated, one or more motors will work. Mounting plate 64 is fixed in relation to stator plate 90 so that the slewing of rotor 80 rotates rotor 80 relative to mounting plate 64. The continuous transmission of energy and power through satellite sprockets 78 is facilitated by drive belt(s) 82 and advantageously also by the use of synchronization belt(s) 92. That is, the synchronization belt(s) 92 maybe optional, although the use of synchronization belts(s) 92 may provide for the continued operation in the event of failure of one of the components or loads 76. Drive belts 82 illustrated are intended to depict toothed belts, although non-toothed belts, chains or other flexible looped drive members will also work, collectively referred to herein, without limitation, as drive belts. Tension on drive belt(s) 82 is maintained by idlers 62*b*. Tension on synchronization belt 92 is maintained by idlers 78*a*.

Drive sprockets 62*a* are always in contact with drive belts 82 so as to transfer power from each electric motor 62 to the drive belts 82. Thus as rotor 80 slews, and in the embodiment of FIGS. 11-19 one-by-one the satellite sprockets 78 lose contact with one of the drive belts drive belt 82 as rotor 80 rotates relative to mounting plate 64, each drive belt 82 maintains driving contact with a plurality of satellite sprockets 78 at any one time. In embodiments employing synchronization belt(s) 92, the synchronization belts maintain continuous contact with all of the satellite sprockets.

Figure 18:
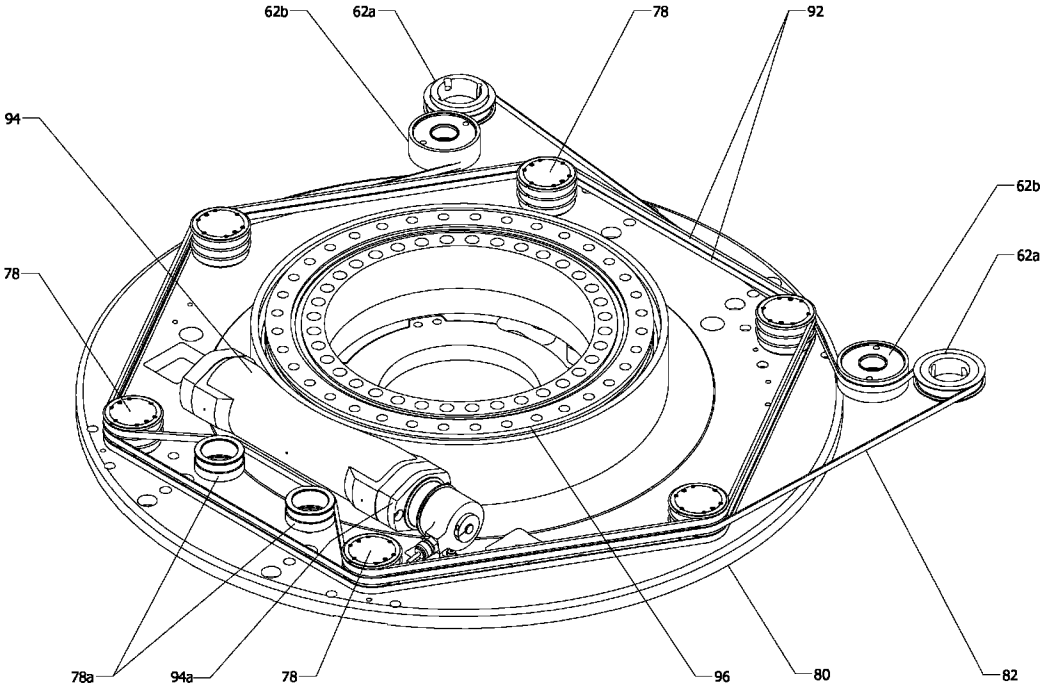
FIG. 18 is the perspective view of FIG. 17 with the stator plate, hydraulic reservoir, and worm drive housing cutaway to expose the full circumferential extend of the synchronization and drive belts.

As rotor 80 continues to rotate, the satellite sprocket 78 will regain contact with drive belt 82. The portion of the rotation of rotor 80 about axis A between the loss of contact of an individual satellite sprocket 78 and drive belt 82 and the regaining of contact with the same drive belt 82 is hereinafter referred to as the drive gap. The angular magnitude of the drive gap is referred to as the drive gap angle. In the example of FIG. 18 two motors 62 drive corresponding drive sprockets 62*a* which in turn drive two corresponding drive belts 82. Thus each motor 62 drives it's own drive belt 82. If only one motor and one drive belt were used, then, because the satellite sprockets pass through a drive gap 82*a* (i.e., where the drive belt is pulled away from the trajectory of the satellite sprockets so as to pass around the drive sprocket) a synchronization belt 92 would be required to continue to drive the satellite sprockets as they pass through the drive gap. With the use of two motors and two corresponding drive belts, if the drive sprockets are sufficiently spaced apart by a drive sprocket angular spacing around slewing axis A, then, as the rotor is slewed about axis A, and a satellite sprocket passes through a first drive gap 82*a*, that satellite sprocket is still in contact with, and its rotation driven by, the second drive belt. If the rotor continues to rotate about slewing axis A so that the satellite sprocket passes through the second drive gap 82*a*, that satellite sprocket is still in contact with, and its rotation driven by, the first drive belt. Thus in this embodiment the synchronization belt 92 is not required, but may be provided for redundancy in the event one of the motors or one of the drive sprockets or drive belts fail.

Figure 18A:
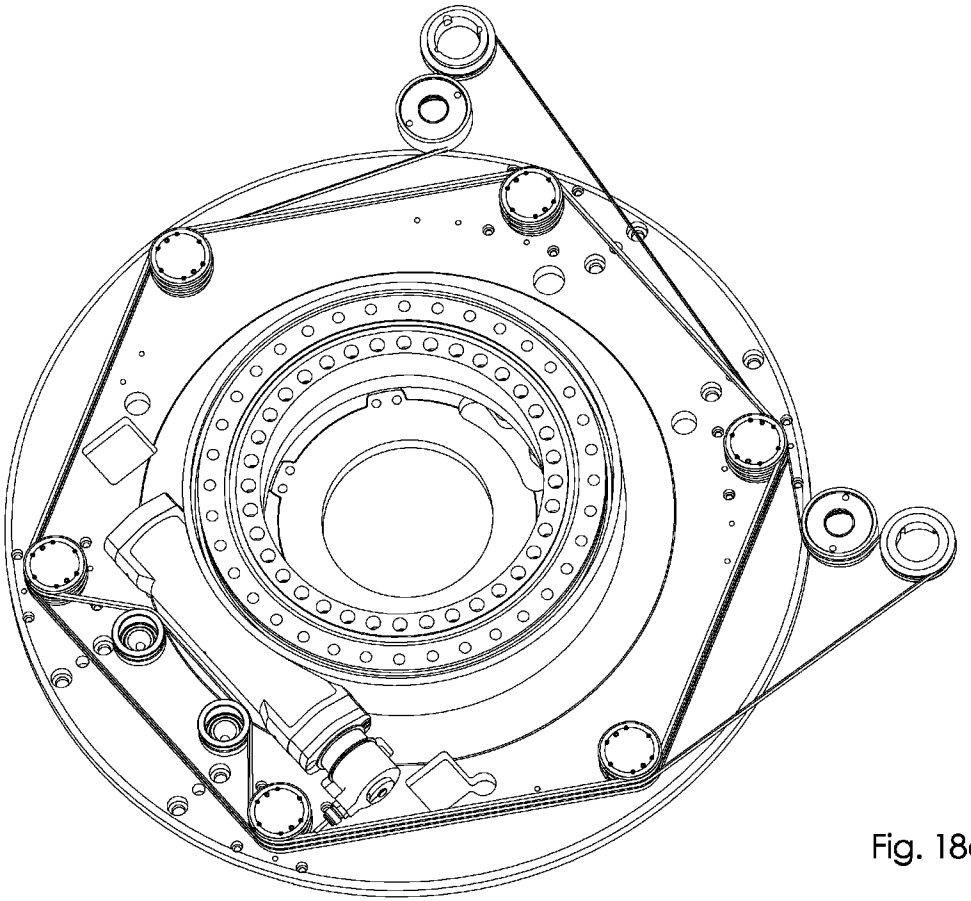
FIG. 18*a* is the cut-away view of FIG. 18 seen in plan view.
Figure 18A:
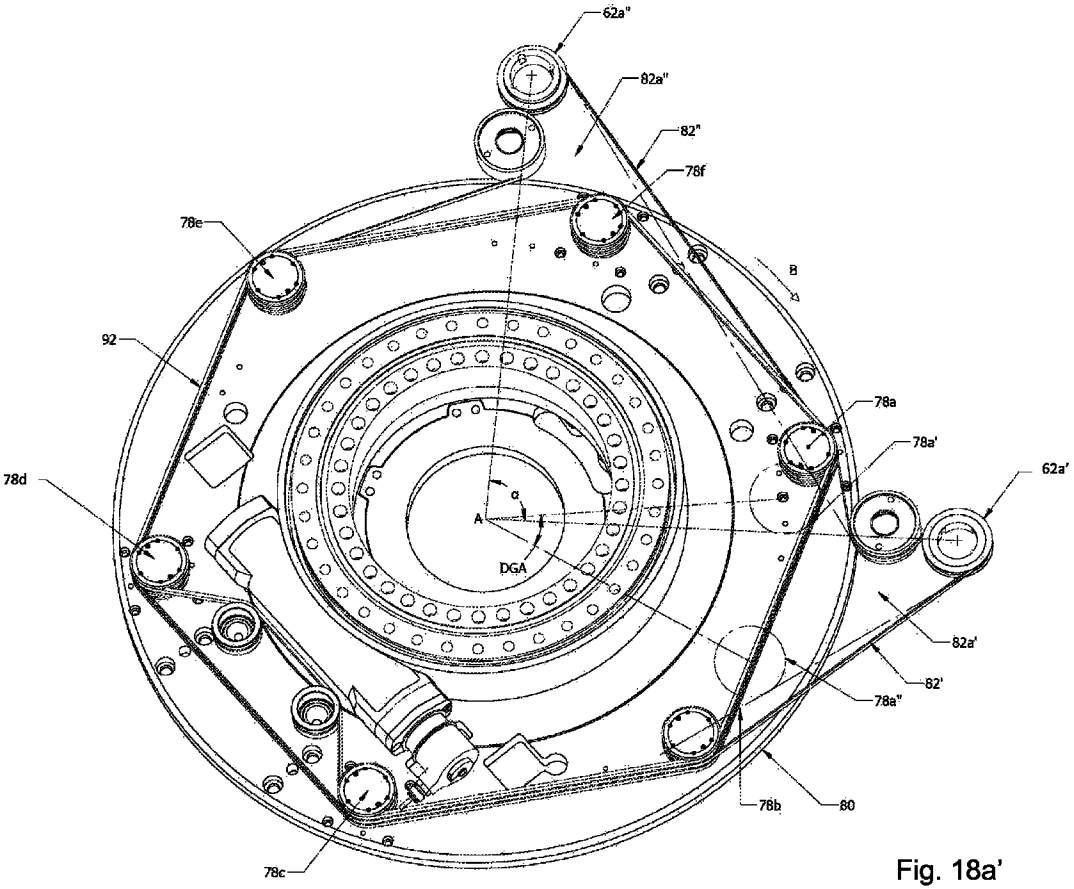
Figure 19:
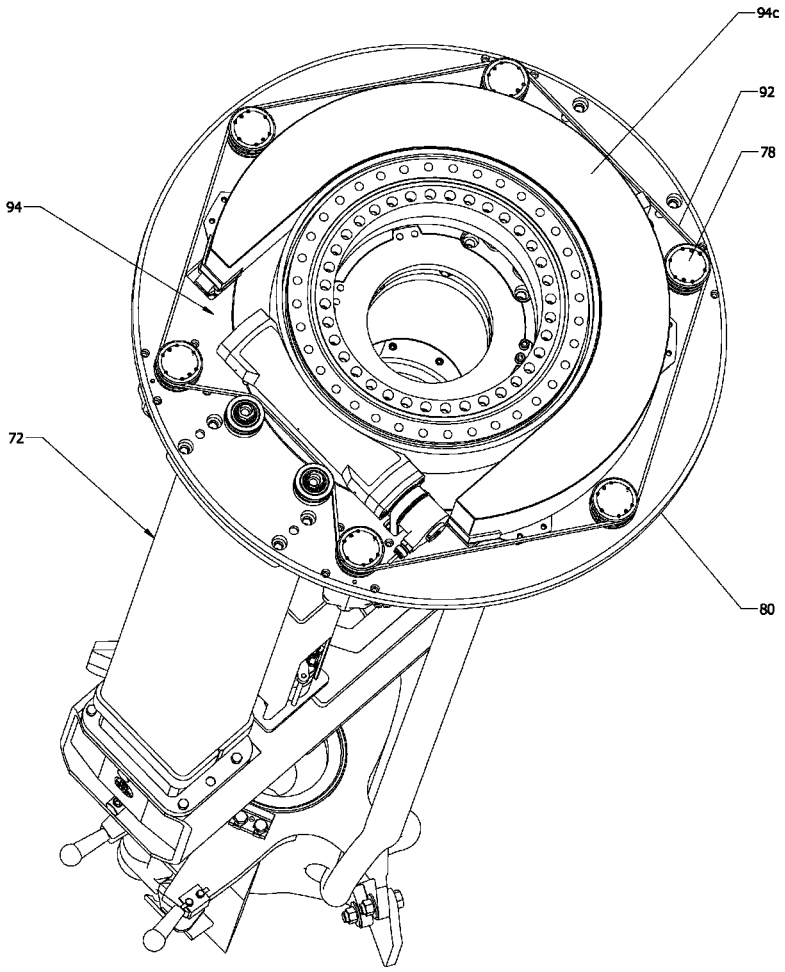
FIG. 19 is, in partially cutaway top perspective view, the slewing power transmission with a pipe handling assembly mounted thereunder.

In FIG. 18*a*', the satellite sprockets 78 are given consecutive reference numerals 78*a*-78*f*, the drive sprocket 62*a* for the first motor 62 is given reference numeral 62*a*' and the drive sprocket for the second motor is given reference numeral 62*a*". The drive belt for drive sprocket 62*a*' is given reference numeral 82' and the drive belt for drive sprocket 62*a*" is given reference numeral 82". The drive gap for drive sprocket 62*a*' is given reference numeral 82*a*' and the drive gap for drive sprocket 62" is given reference numeral 82*a*". Drive Gap 82*a*' has a corresponding drive gap angle DGA. Drive gap angle DGA is shown and defined as the angle about axis A between the two positions 78*a*' and 78*b*' shown in phantom circle outline) of satellite sprocket 78*a* as it rotates in direction B on rotor 80 and detaches from drive belt 82" and re-attaches to drive belt 82' respectively. Drive belts 82' and 82" are shown as dotted straight lines, as they would be substantially linear as each satellite sprocket detaches and re-attaches. It is understood that each satellite sprocket 78*a*-78*f* would pass through positions 78*a*' and 78*a*". That is, corresponding drive gap angles are formed as each satellite sprocket 78*a*-78*f* detaches from drive belt 82" and re-attaches to drive belt 82' in the positions shown as phantom outlined circles 78*a*' and 78*a*". Drive gap 82*a*" would have a corresponding drive gap angle about slewing axis A.

Drive sprockets 62*a*' and 62*a*" are spaced apart by a drive sprocket angular spacing $\acute{\alpha}$. The drive sprocket angular spacing $\acute{\alpha}$ preferably exceeds the drive gap angle DGA so that at all points of angular rotation of rotor 80, each of the satellite sprocket 78*a*-78*f* is in contact with and driven by at least one of the drive belts 82 (82' or 82"), even in the absence of a synchronization belt 92.

Thus the duplication of the drives 62 in their spaced apart or phase-shifted orientation provides for the fail-safe continuity in the supply of power or energy y across the slewing interface to the pipe handler.

As illustrated in FIGS. 11-19, drive belt 82 maintains contact with a minimum of five satellite sprockets 78 when, as illustrated, six satellite sprockets 78 are mounted on rotor 80 equally spaced apart around the circumference of the rotor. As individual satellite sprockets 78 lose contact with one drive belt 82 they remain driven and in phase by the other drive belts 82, and, in embodiments employing a synchronizer such as synchronization belt(s) 92 in phase with the other satellite sprockets 78 by the operation of the synchronizer. Satellite sprockets 78 therefore continuously transfer power to their corresponding accessories, components or loads 76. The use of synchronization belt 92 in the illustrated embodiment is useful because any one of the three belts of the one synchronization belt 92 and the two drive belts 82 may fail and the system will still continue to operate to continuously transfer energy or power across the slewing interface.

Satellite sprockets 78 may also power an energy storage device, or an energy conveyor, for example an energy conveyor chosen singly or in combination from, without intending to be limiting: an energy transfer medium cooperating between at least one satellite sprocket 78 and for example the pipe handler grip, at least one hydraulic fluid pump, at least one pneumatic pump, at least one fluid pump which is other than hydraulic or pneumatic, at least one generator, at least one alternator, a mechanical drive, or a mechanical linkage.

The energy storage device may be for example at least one gas accumulator, at least one battery, at least one capacitor or at least one flywheel.

Although in the illustrations, the synchronizer of the satellite sprockets 78 is shown as belt 92, one skilled in the art would appreciate that other forms of synchronization would also work and are intended to fall within the intended meaning of the word synchronizer. For example a synchronizer may also include the use of gears, a flexible shaft, a rigid shaft with right-angle gearboxes, a hydraulic or other fluid system to synchronize the movement of the satellite sprockets.

What is claimed is:

1. A power transmission for a slewing interface comprising:

a rotor rotatable relative to a stator about a slewing axis, at least one drive sprocket mounted on said stator adjacent said rotor;

a first drive cooperating with said at least one drive sprocket, at least two satellite sprockets on said rotor spaced around said rotor, a synchronizer synchronizing rotation of all of said at least two satellite sprockets;

at least one drive belt mounted around said at least one drive sprocket and around said at least two satellite sprockets in driving engagement collectively therewith, wherein power is delivered continuously from said first drive to said at least two satellite sprockets at all times during rotation of said rotor about said slewing axis.

2. The transmission of claim 1 further comprising a slewing drive acting between said rotor and said stator whereby said rotor is selectively slewed relative to said stator about said slewing axis.

3. The transmission of claim 2 wherein said rotor is adapted for mounting an object thereto for rotation with said rotor.

4. The transmission of claim 3 wherein said object is mounted to said rotor.

5. The transmission of claim 4 wherein said object is a pipe handler.

6. The transmission of claim 3 wherein said satellite sprockets are mounted substantially equally radially spaced from said slewing axis.

7. The transmission of claim 6 wherein said satellite sprockets are mounted so that a satellite sprocket spacing between adjacent said satellite sprockets is substantially equal.

8. The transmission of claim 7 wherein said satellite sprocket spacing and said equal radial spacing of said satellite sprockets, a diameter of each of said satellite sprockets, and a spacing of said at least one drive sprocket from said slewing axis and said satellite sprockets is such that said drive belt will not contact said object when said object is mounted to said rotor during rotation of said rotor about said slewing axis.

9. The transmission of claim 1 further comprising a tensioner cooperating with said drive belt to maintain tension in said drive belt as said rotor rotates.

10. The transmission of claim 1 wherein said drive belt is at least one flexible loop member including from the group comprising belt, chain, cable.

11. The transmission of claim 1 wherein said synchronizer is at least one flexible loop member including from the group comprising belt, chain, cable, wherein said at least one flexible loop member is mounted around all of said at least two satellite sprockets.

12. The transmission of claim 1 wherein said at least two satellite sprockets is at least three satellite sprockets.

13. The transmission of claim 12 wherein said at least three satellite sprockets is at least four satellite sprockets.

14. A system comprising the transmission of claim 1 wherein said stator includes a top drive, and wherein a pipe handler is mounted to said rotor.

15. A system according to claim 14 further comprising at least one load mounted on said rotor and coupled to said at least one satellite sprocket, wherein said load comprises one or more of the following: at least one hydraulic fluid pump, at least one pneumatic pump, and at least one electrical generator wherein said at least one load powers at least one pipe handler function chosen from the group comprising: a gripper, a gripper positioner, a link tilt, a valve actuator, an elevator operator.

16. The system of claim 15 wherein said at least one load powers an electrical control system and wireless communication.

17. A power transmission for a slewing interface comprising:

a rotor rotatable relative to a stator about a slewing axis, at least one drive sprocket mounted on said stator adjacent said rotor, a first drive cooperating with said at least one drive sprocket, at least two satellite sprockets on said rotor spaced around said rotor, at least one drive belt mounted around said at least one drive sprocket and around said at least two satellite sprockets in driving engagement collectively therewith, wherein power is delivered continuously from said first drive to at least one of said at least two satellite sprockets at all times during rotation of said rotor about said slewing axis; and wherein said at least one drive sprocket is at least two drive sprockets, and wherein said drive belt is a corresponding at least two drive belts; one said drive belt of said at least two drive belts for each drive sprocket of said at least two drive sprockets, and wherein each said drive belt disengages from said at least one of said satellite sprockets across a corresponding drive gap as said rotor said rotates, and wherein said at least two drive sprockets are spaced apart by a drive sprocket angular spacing, and wherein said drive sprocket angular spacing is greater than the angular magnitude of any of said drive gaps.

18. The transmission of claim 17 further comprising at least one load mounted on said rotor and coupled to said at least one satellite sprocket, wherein said load comprises an energy conveyor chosen singly or in combination from the group comprising: an energy transfer medium, at least one hydraulic fluid pump, at least one pneumatic pump, at least one fluid pump which is other than hydraulic or pneumatic, at least one generator, at least one alternator, a mechanical drive, a mechanical linkage, an electric drive.

19. The transmission of claim 18 wherein said at least one load powers at least one pipe handler function chosen from the group comprising: a gripper, a gripper positioner, a link tilt, a valve actuator, an elevator operator.

20. The transmission of claim 18 wherein said at least one load powers an electrical control system.

21. The transmission of claim 18 wherein said at least one load powers wireless communication.

22. The transmission of claim 18 wherein said load includes energy storage from the group comprising at least one gas accumulator, at least one battery, at least one capacitor, at least one flywheel.

23. The transmission of claim 18 wherein said first drive runs continuously to continuously supply said power to said at least one load, independently of said rotation of said rotor.

24. The transmission of claim 17 wherein said rotor is substantially a plate.

25. The transmission of claim 24 wherein said stator is substantially a plate, and said first drive is mounted to said stator.

26. A system comprising the transmission of claim 17 wherein said stator includes a top drive, and wherein a pipe handler is mounted to said rotor, and wherein said stator includes a first central opening and said rotor includes a second central opening aligned along said slewing axis with said first central opening for receiving a quill extending from said top drive and through said first and second central openings.

27. The transmission of claim 17 further comprising a synchronizer synchronizing rotation of all of said at least two satellite sprockets.

* * * * *